US006932335B1

(12) United States Patent
Dykstra

(10) Patent No.: US 6,932,335 B1
(45) Date of Patent: Aug. 23, 2005

(54) LOCKING CLAMP

(75) Inventor: Henry Dykstra, Lenox, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/836,010

(22) Filed: Apr. 29, 2004

(51) Int. Cl.[7] ..... B25B 1/14
(52) U.S. Cl. ..... 269/228; 269/201
(58) Field of Search ..... 269/228, 201, 269/32, 236, 138, 199, 196

(56) References Cited

U.S. PATENT DOCUMENTS 3,924,844 A * 12/1975 Bachtel, Jr. ..... 269/94
5,527,024 A * 6/1996 Dysktra ..... 269/94
5,961,109 A * 10/1999 Dykstra et al. ..... 269/228
6,595,507 B2 * 7/2003 Dykstra ..... 269/228
6,817,603 B2 * 11/2004 Kofod ..... 269/228

* cited by examiner

*Primary Examiner*—Lee D. Wilson
(74) *Attorney, Agent, or Firm*—Raggio & Dinnin, P.C.

(57) ABSTRACT

A locking clamp that includes a base member. The locking clamp further includes a bar pivotally connected to the base member on one end thereof. A handle is pivotally connected to a base member on an end opposite of the bar. The clamp further includes a link connected to the handle and the bar. The link has a stopper extending from a side thereof. The clamp also includes a locking lever for use in locking the clamp in its fully closed/fully engaged position.

20 Claims, 3 Drawing Sheets

LOCKING CLAMP

BACKGROUND OF THE INVENTION

1. Field of the Invention

The present invention relates to clamps generally, and more particularly, relates to a locking manual hold down clamp.

2. Description of Related Art

Toggle and hold down clamps have been used and known in the art for many years. A typical hold down or toggle clamp includes a clamping arm which pivots between a released and clamped position. The clamps are used to hold work pieces in place for processing, for clamping two objects to one another, or for clamping an object to a work table or other surface. Toggle and hold down clamps generally are quickly engageable and disengageable to the work piece or object being held. They also provide a considerable holding and clamping force which enables them to hold the work piece or object securely where needed.

Many of these prior art devices hold the clamp position to a variety of means, these means include maintaining the force applied to the bar or arm of the clamp. Other prior art clamps create a holding force by passing the links of the toggle clamps to an over center position, the over center position subjects the links and the pivot points of the clamp to very high loads resulting in increased wear and potential deformation of the clamp components thereby reducing the life of the clamp.

There have been some problems with some prior art clamps releasing due to vibration and other unforeseen forces during the use of the clamps. Some of these prior art clamps include several bends in their links and power arms. These bends may reduce performance and strength of the clamp by amounts up to 30 to 40 percent. Some of these clamps also include parts that have bends that are not interchangeable and have to be put together in precise positions, thus increasing the cost of labor of assembling the clamps. Also many of these prior art clamps do not include a positive locking mechanism which will ensure the clamp is locked and not capable of being opened when it is in its fully engaged position. The positive locking of the clamp is necessary in manufacturing environments where the unexpected disengagement of a clamp may produce hazards and other down time on manufacturing lines because of such unexpected releases.

Therefore, there is a need in the art for an improved locking hold down action clamp that is more robust, has greater strength and interchangeability than prior art clamps. There also is a need in the art for a locking clamp that has a positive lock that will only disengage upon user interaction with the locking mechanism of the clamp.

SUMMARY OF THE INVENTION

One object of the present invention is to provide an improved locking clamp.

Another object of the present invention is to provide a more robust locking clamp.

Still another object of the present invention is to provide a locking hold down clamp with fewer bend in the clamp parts which strengthens the individual parts and reduces their cost.

Still a further object of the present invention is to provide a clamp that has a positive locking mechanism.

Still another object of the present invention is to provide a clamp that reduces the number of different parts stamped in order to build a specific number of locking clamps.

Still a further object of the present invention is to provide a clamp that needs user intervention to disengage the clamp from its locked or fully engaged position.

It is still a further object of the present invention to provide a clamp that eliminates the need for any high cost and complex parts to create an over center stop and to create a clamp that has a locking mechanism for easy use by an operator.

To achieve the foregoing objects the locking clamp, according to the present invention, includes a base member. The clamp also includes a bar pivotally connected to the base member. A handle is pivotally connected to the base member. The clamp also includes a link connected to the handle and the bar. The locking clamp also includes a lever connected to the handle wherein the lever locks the clamp in a fully engaged position.

One advantage of the present invention is that the locking clamp is more robust and removes any bends and replaces them with straight parts in the clamp.

Another advantage of the present invention is that the locking clamp has increased strength.

Still a further advantage of the present invention is that the locking clamp provides for interchangeability of parts.

Another advantage of the present invention is that the locking clamp includes a locking mechanism that positively locks the clamp in its fully engaged position.

Another advantage of the present invention is that the locking mechanism of the locking clamp can only become disengaged with specific action taken by an operator of the clamp.

Still a further advantage of the present invention is that the locking mechanism is capable of use by both right handed and left handed operators of the clamp.

Other objects, features, and advantages of the present invention will become apparent from the subsequent description, and the appended claims, taken in conjunction with the accompanying drawings.

DESCRIPTION OF THE PREFERRED EMBODIMENT(S)

Figure 1:
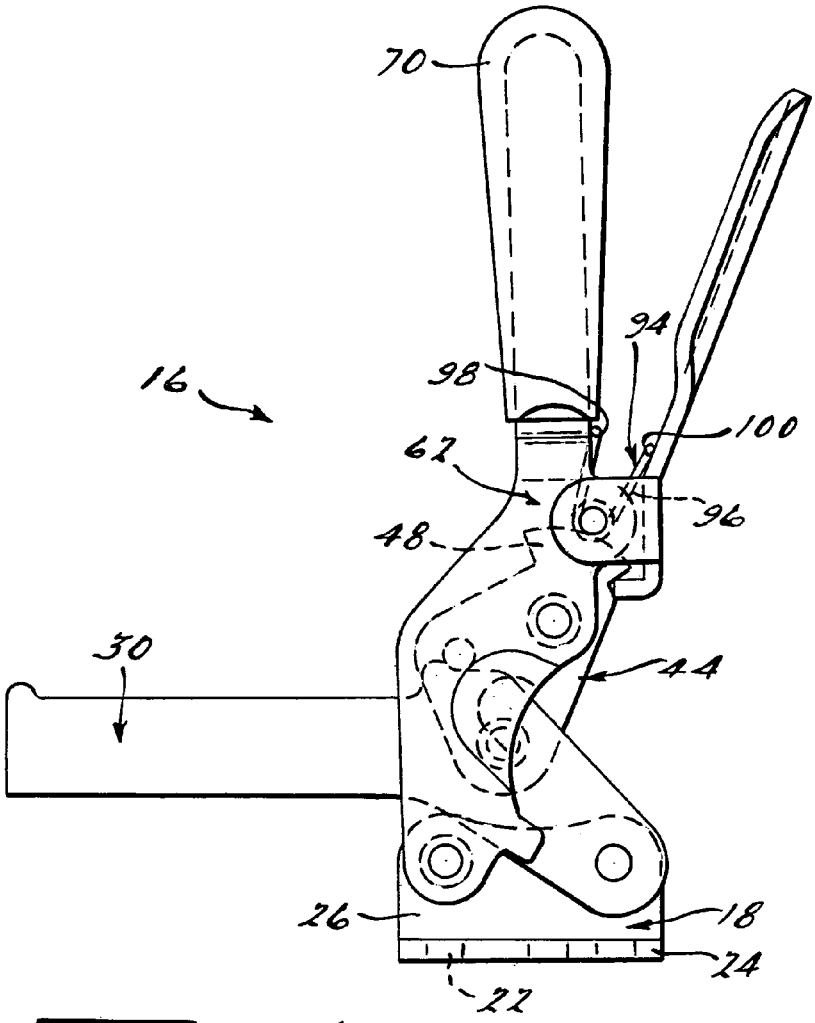
FIG. 1 shows a side view of the present invention.
Figure 2:
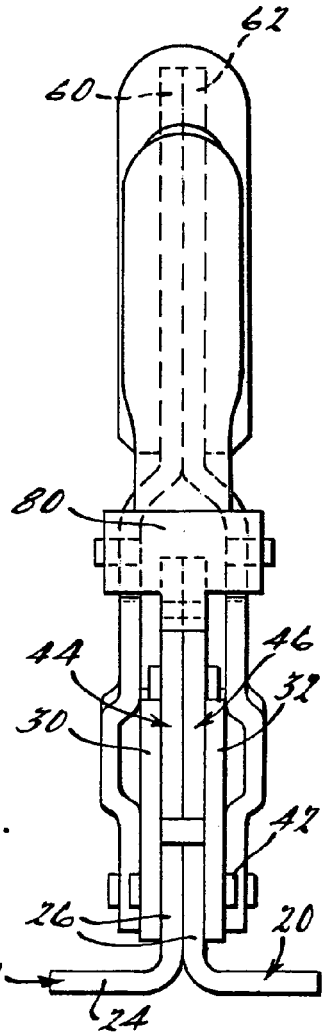
FIG. 2 shows an end view of the present invention.
Figure 4:
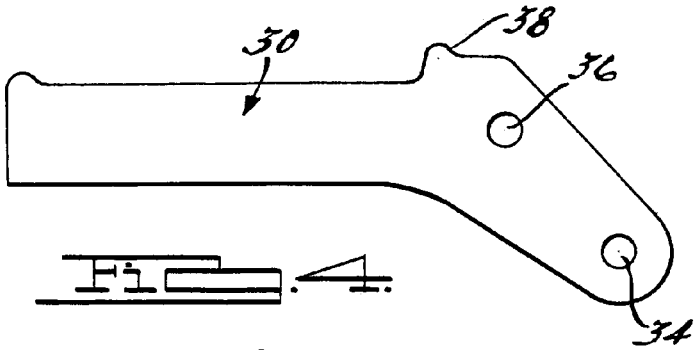
FIG. 4 shows a side view of a bar member according to the present invention.
Figure 3:
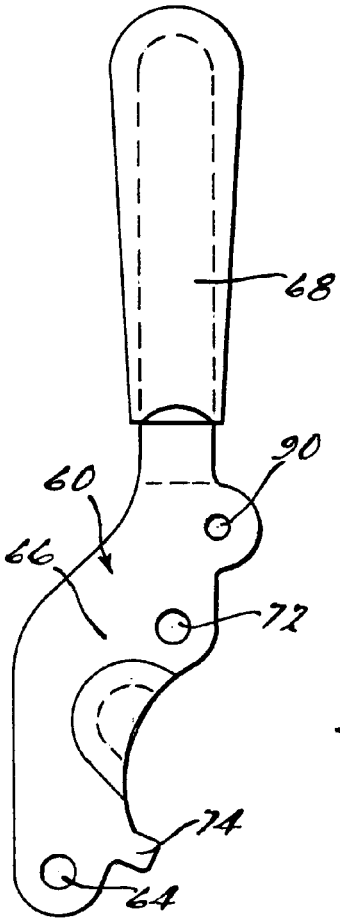
FIG. 3 shows a side view of a handle according to the present invention.

The invention will now be described with reference to the drawings, wherein like numerals in different drawing figures indicate like elements.

FIGS. 1 through 10 show one embodiment of a locking clamp 16 according to the present invention. The clamp 16 includes a first and second base member 18, 20 with each base member 18, 20 generally having an L-shaped cross section. The base members 18, 20 include a plurality of orifices 22 through a bottom surface thereof and a side surface thereof. The bottom flange 24 of the base member 18, 20 generally has two orifices 22 therein and those orifices are used to secure, via any known fastener, the clamp 16 to a bench, tool or other work device. The upright portion 26, 28 of the base member 18, 20 includes a first and second orifice that are used to connect to the other parts of the clamp 16. The base members 18, 20 are placed such that the upright portion 26 of the base members 18, 20 are in contact with one another and the bottom flange 24 of the base members 18, 20 extend away from each other as shown. It should be noted that in the preferred embodiment all of the working parts of the clamp 16 are made out of a metal material, preferably a steel. However it should be noted that any other type of hard metal, hard ceramics, or plastics may be used in the design of the clamp 16. It should further be noted that the base members 18, 20 may be mechanically or chemically bonded to one another to form a single integral unit. The base members 18, 20 may also be used as two separate members as described above.

Contacting an outside surface of the first and second upright portion 26 of the base member 18, 20 are a first and second power arm or bar member 30, 32. The power arm or bar member 30, 32 is flat and straight along its edge, such that no bends or offsets occur on the bar 30, 32. The bar member 30, 32 includes a first and second orifice 34, 36 and also includes a notch or knob 38 along one surface thereof. On one end of the bar member 30, 32 is a second knob 40 which is used to secure a holder member on the clamp 16. The first and second bar members 30, 32 are pivotally connected to the up right portion 26 of the base members 18, 20 on opposite sides of the base members 18, 20 such that the first and second base members 18, 20 are disposed between the first and second bar members 30, 32. The bar members 30, 32 are connected, via a rivet 42 to the first and second base member 18, 20 at the first orifice 34 of the bar member 30, 32. It should be noted that any other type of fastener may also be used to connect the bar members 30, 32 to the base members 18, 20 such as but not limited to a pole, pin, dowel, screw, or any other known fastener may also be used. The bar member 30, 32 is arranged and connected to the base member 18, 20 such that the notch 38 faces in the direction opposite of the base member 18, 20 when the clamp 16 is in the fully engaged or closed position.

Figure 5:
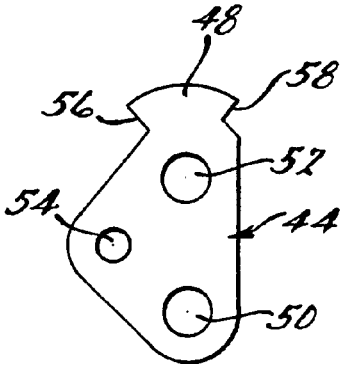
FIG. 5 shows a side view of a link member of the present invention.
Figure 6:
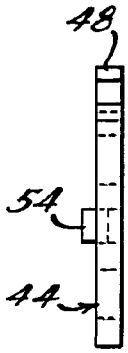
FIG. 6 shows an end view of a link member according to the present invention.
Figure 7:
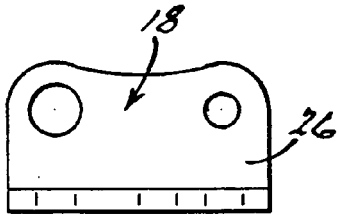
FIG. 7 shows a top view of a base member according to the present invention.
Figure 8:
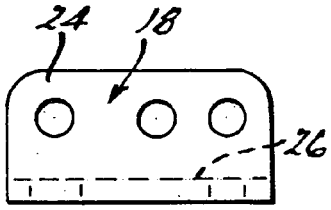
FIG. 8 shows a top view of a base member according to the present invention.

Link members 44, 46 as shown in FIGS. 5 and 6 generally have a triangular shape. A wedge like extension 48 extends from one end of the triangular shaped link members 44, 46. The link members 44, 46 include a first and second orifice 50, 52 and a stopper or button 54 extending from a side surface thereof. The first and second link members 44, 46 are pivotally connected to the bar members 30, 32 at the second orifice 36 of the bar member 30, 32 and the first orifice 50 of the link member 44, 46 via a fastener. It should be noted that any known type of fastener such as, but not limited to, a rivet, dowel, pin, pole, screw, nail, etc., may also be used to secure the link members 44, 46 to the bar members 30, 32. The pin includes a shoulder surface that engages with the bar members 30, 32. The first and second link members 44, 46 are secured back to back such that the buttons 54 extend from each side of the link members 44, 46 and are able to interact with the notch 38 found on the top surfaces of the bar members 30, 32. An outer surface of the first and second link member 44, 46 is adjacent to an inner surface of the first and second bar members 30, 32 respectively. Therefore, the first and second link members 44, 46 are disposed between the first and second bar members 30, 32 in the clamp 16. It should be noted that the button 54 is pressed out of the side of the link member 44, 46 via a punching operation and therefore, a weld is not needed to create an over center stop for the hold down clamp 16. However, it should be noted that any other type of machining, molding or casting process can be used to create the button 54 extending from the side of the link member 44, 46. The wedge like extension 48 extending from an end of the link members 44, 46 will serve to create a first and second shoulder stop or surface 56, 58 at each end of the wedge like extension 48.

The clamp 16 includes first and second handle members 60, 62. The first and second handle members 60, 62 are pivotally connected to the base members 18, 20 via a first orifice 64 in the handle 60, 62. The handle member 60, 62 generally has a body portion 66 and an arm 68 extending from the body portion 66. The body portion 66 and the arm 68 intersect at an off set or bend in the handle member 60, 62. The handle member 60, 62 is the only part of the clamp 16 that includes an off set or bend, within all of the moving parts of the clamp mechanism. The link members 44, 46 and the bar members 30, 32 are straight and therefore increase the strength of the clamp 16, on the order of 30 to 40 percent over prior art clamps. The handle members 60, 62 include the off set such that all moving parts of the clamp 16 are located within the first and second handle members 60, 62, and therefore prevent any pinch points from interacting with the user of the clamp. The handle members 60, 62 are pivotally connected to the base members 18, 20 such that the arms 68 of the first and second handle members 60, 62 contact each other and have a grip 70 made out of a plastic, rubber, cloth or like material, fixed over the ends of the two handle members. The handle members 60, 62 also pivotally connect, via its second orifice 72, to the second orifice 52 of the link member 44, 46. The connection is made via a fastener, preferably a rivet, however it should be noted that any other type of pole, pin, screw, nail, etc., may also be used, that includes a bushing surrounding the rivet. The pivot connection of the handle member 60, 62 to the base member 18, 20 is secured by a fastener. In one embodiment that fastener is a rivet and a bushing, however any other type of fastener, such as a screw, pole, dowel, pin, nail, etc., may also be used.

The first and second handle members 60, 62 also include a leg member 74 which extends from a surface of the body 66. The leg member 74 contacts the flange of the first and second base member 18, 20 when the clamp 16 is in the open/disengaged position. When the leg member 74 is in contact with the base member 18, 20 the arm 68 of the handle 60, 62 is a predetermined angle from the base member 18, 20. This angle provides for increased clearance for the hands and fingers of the operator of the clamp 16. In the preferred embodiment the angle is approximately 30°, however it should be noted that any angle from 10° to 85° may be designed into the clamp 16. The handle member 60, 62 is positioned such that an inside surface of the first and second handle members 60, 62 are adjacent to an outside surface of the first and second bar members 30, 32. The handle members 60, 62 are arranged such that the first and second bar members 30, 32 and the first and second base members 18, 20 along with the first and second link members 44, 46 are all disposed between the first and second handle members 60, 62 within a space provided by the offset of the first and second handle members 60, 62. It should be noted that the first and second handle members 60, 62 are the only members of the clamp 16 to have a specific left hand and right hand part. All other parts of the clamp 16 including the base members 18, 20 are interchangeable and therefore reduce the number of different parts that have to be stamped in assembling a predefined number of clamps. It should further be noted that the link members 44, 46, the bar members 30, 32 and the handle members 60, 62, all may be combined into a single unitary part for each of the above referenced members. Hence, the first and second handle members 60, 62 would become one single piece, the first and second bar members 30, 32 would become one single piece, the first and second link members 44, 46 would become one single piece, etc.

Figure 9:
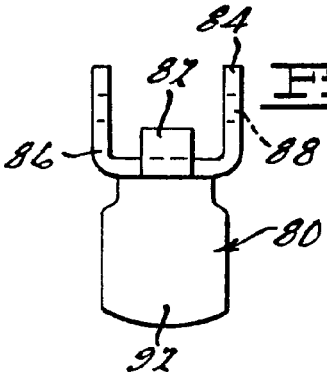
FIG. 9 shows an end view of a lever member according to the present invention.
Figure 10:
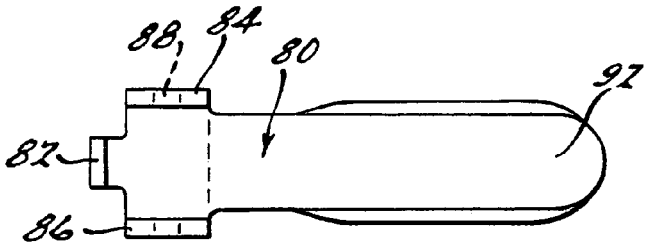
FIG. 10 shows a top view of a lever member according to the present invention.

As shown in FIGS. 9 and 10 the clamp 16 includes a lever 80 for locking the clamp 16 in its fully closed/fully engaged position. The lever 80 has a locking tab 82 extending from one end thereof. Adjacent to the locking tab 82 are a first and second flange 84, 86 that extend a predetermined distance from the sides of the lever 80. The flanges 84, 86 have an orifice 88 therethrough that align with one another and allow for the lever 80 to be pivotally connected to a third orifice 90 on the handle members 60, 62. The lever 80 has a generally "shoe-horn" shaped extension 92 extending in a direction opposite of that of the locking tab 82. The extension 92 generally has a curved shape across the width thereof. The curved surface of the extension 92 will allow for comfortable use by a user's fingers or palm. The pivotal connection between the lever 80 and the handle 60, 62 uses a pin, rivet, dowel, screw, nail, or any other known fastener. The locking tab 82 of the locking lever 80 will engage with the shoulder or stop portion 58 of the link members 44, 46. This engagement will occur when the clamp 16 is in its fully engaged/closed position. The lock lever 80 will ensure that the clamp 16 has a positive lock and can only open or become disengaged if the locking lever 80 is moved towards the handle 60, 62 of the clamp 16.

A spring 94 is arranged around the fastener that secures the lever 80 to the handle members 60, 62. The spring 94 is a torque spring. However, it should be noted that any other type of known spring may be used for the present invention. The torque spring 94 will have a predetermined number of coils that have a predetermined inner diameter that is capable of being arranged around the rivet or fastener. The spring 94 has a first and second arm 96, 98 extending from the coils thereof. The first and second arms 96, 98 of the torque spring 94 each have a finger 100 extending from an end thereof. One of the torque spring fingers 100 will be in contact with a surface of the handle members 60, 62. The other of the torque spring fingers 100 will be in contact with a surface of the lever 80. The torque spring 94 will urge, via its spring force, the locking lever 80 away from the handle members 60, 62. This will ensure that the locking tab 82 or the locking lever 80 will stay fully engaged with the locking shoulder 58 of the link members 44, 46. When an operator of the clamp 16 squeezes or rotates the locking lever 80 in the direction of the handle members 60, 62 this will compress the spring 94 and allow for the engaged locking tab 82 to disengage from the locking shoulder 58 of the link members 44, 46 thus allowing for the clamp 16 to be opened/disengaged from the object being held. It should be noted that in one embodiment the spring 94 is made of a metal material preferably steel, however any other known metal, ceramic, plastic or composite material may be used for the torque spring 94. It should also be noted that it is contemplated to have the torque spring 94 arranged on an inner surface of the flange of the lever 80, thus having the spring 94 arranged within the clamp 16 to avoid snagging or other damage thereto in the manufacturing environment. It should also be noted that any size coil, arms, and fingers may be used on the torque spring 94. It should be noted that any size or shape may be used for the extension 92 on the locking lever 80 and that the embodiment shown uses the curved surface for ergonomic purposes.

Figure 13:
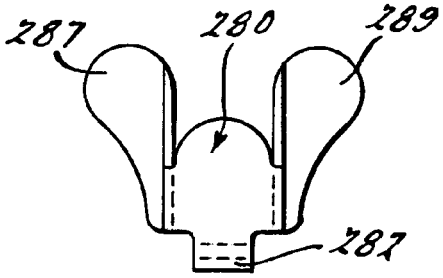
FIG. 13 shows an alternate embodiment of a lever member according to the present invention.
Figure 14:
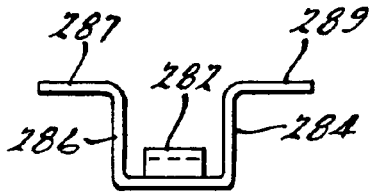
FIG. 14 shows a side view of an alternate embodiment of a lever member according to the present invention.
Figure 15:
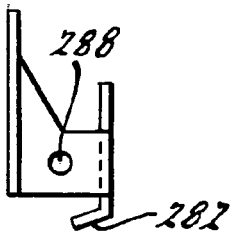
FIG. 15 shows a side view of an alternate embodiment of a lever member according to the present invention.

FIGS. 11 through 15 show an alternate embodiment of the locking clamp 216 according to the present invention. FIGS. 13 through 15 show the alternate locking lever 280 for use with the present invention. The other portions of the clamp 216 are the same as those described above. The lever 280 includes a locking tab 282 extending from one end thereof. A first and second flange 284, 286 extend from the lever 280 and each have a wing shaped tab or extension 287, 289 extending therefrom. The wing shaped extensions 287, 289 form a "butterfly" like shaped lever. The wing shaped extensions 287, 289 will allow for a left handed or right handed user to operate the clamp locking lever 280. An orifice 288 is arranged through each of the flanges 284, 286 and aligned with one another such that the locking lever 280 will be pivotally connected to the handle members 260, 262 via the orifices 288 and a third orifice 290 in the handle member 260, 262. In the embodiment shown a rivet is used to connect the locking lever to the handle member. However, it should be noted that any other type of pin, dowel, pole, nail, screw, etc., may be used as the fastener.

Figure 11:
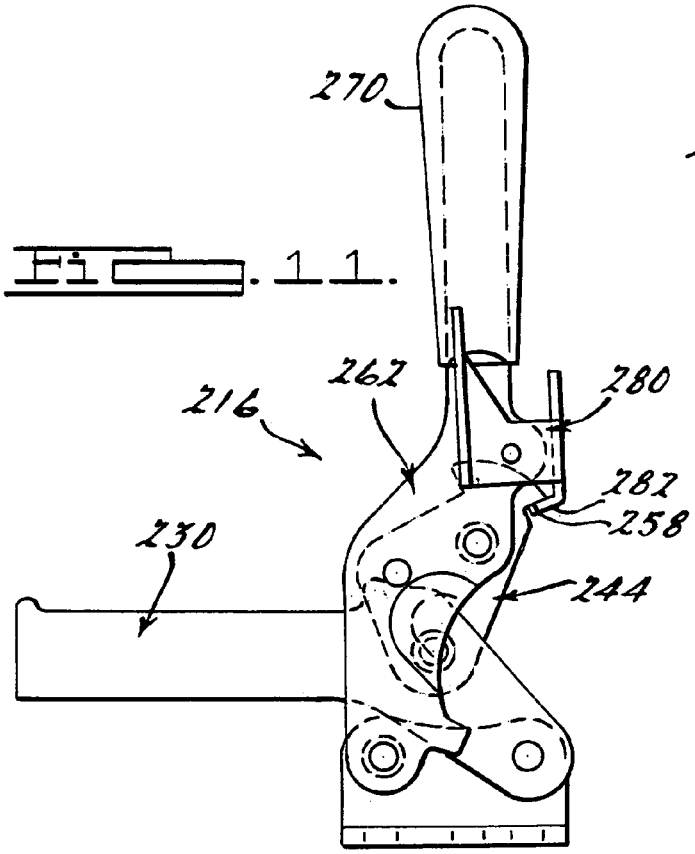
FIG. 11 shows a side view of an alternate embodiment of the present invention.
Figure 12:
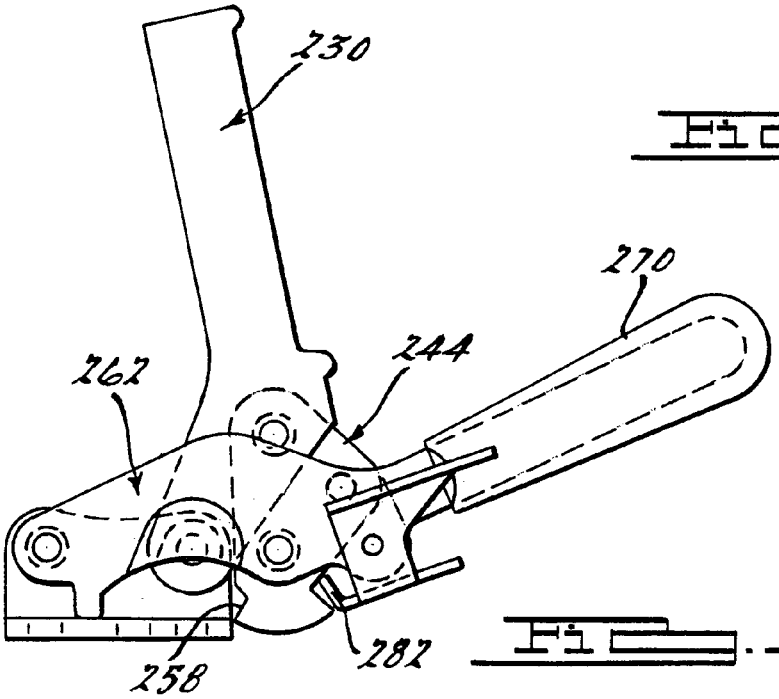
FIG. 12 shows a clamp in its open or fully disengaged position.

As shown in FIG. 11 when the clamp 216 is in its fully engaged/closed position the locking lever 280 will have its locking tab 282 engaged with the locking shoulder 258 of the link members 244, 246. The wing shaped tabs 287, 289 will be aligned with one side of the handle members 260, 262. This will allow for easy functionality and ergonomic use by a user of the clamping mechanism. A torque spring 294 as described above may also be included and arranged between a surface of the locking lever 280 and the handle members 260, 262. FIG. 12 shows the clamp 216 along with a butterfly locking lever 280 when the clamp 216 is in its fully opened/disengaged position.

In operation the clamp 16 is in an open position when the handle member 60, 62 is pulled fully open and the leg 74 rests on the flange 24 of the base member 18, 20. The handle member 60, 62 is designed such that the arm 68 of the handle member 60, 62 has a predetermined angle from the base member 18, 20 such that there is an increase in clearance from the hands and fingers of the operator. It should further be noted that an increase of clearance occurs between the arm 68 of the handle 60, 62 and the bar member 30, 32 which extends in an up right position when the clamp 16 is in the fully open position. This provides for increased clearance such that the knuckles and fingers of the operator are not engaged with the bar member 30, 32 when operating the clamp 16.

When an operator wants to secure the part being clamped the operator will move the handle member 60, 62 into a vertical position from its open/fully disengaged position into a closed/fully engaged position such that the handle 60, 62 is placed into a nearly upright position. This will in turn allow the locking tab 82 of the locking lever 80 to slide along the link members 44, 46 until the locking tab 82 engages and is secured with one of the locking shoulders 58 of the link members 44, 46. The clamp 16 secures the work piece by having an over center position between the power arm 30, link member 44 and handle members 60 such that an over center force is created. This over center force amplifies the force and holding power of the clamp 16. The over center point is engaged when the buttons or stoppers 54 engage with the notch 38 of the bar members 30 to create the over center or high force position for the clamp 16. This force is created by the link members 44, 46 rotating with respect to the handle member 60, 62 and bar member 30, 32. The notch 38 and over center buttons 54 merely define the over center position which creates the greatest force capable by the toggle link of the clamp 16. The locking tab 82 and locking mechanism will then ensure that the clamp 16 stays in the over center position thus allowing for the clamp 16 to operate at its greatest force capable without disengagement by vibrations or other environmental conditions of the manufacturing environment.

It should be noted that the use of an over center button 54 that is punched or formed into the metal is preferred over the prior art use of welding a pin or other device as an over center stop in clamps. This provides for a more reliable over center point thus increasing the strength and durability of the clamp 16. With regards to the interchangeability of all clamps members, excluding the first and second handle members, the use of the members with a straight or linear parts also increases the strength. Any where a bend or offset is located in prior art clamps created stresses and weakens the clamp, thus reducing the overall life of the clamp. The clamp according to the present invention uses all straight or linear parts. The use of the straight or linear members for the link and bar members increases the strength of the clamp by approximately 30 to 50 percent over prior art clamps thus increasing the life and serviceability of clamps in the field. Furthermore the inclusion of a locking lever 80 and locking shoulder on the link members increases the reliability and cost effectiveness of the clamp in the manufacturing environment.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A clamp, said clamp including:

a base;

a bar pivotally connected to said base;

a handle pivotally connected to said base;

a link connected to said handle and said bar, said link having a generally triangular shape with a member extending from one end; and a lever pivotally connected to said handle, said lever locks the clamp in a fully engaged position.

2. The clamp of claim 1 wherein said link having a stopper extending from a side, said link having a first and second orifice, said link having a locking shoulder.

3. The clamp of claim 1 wherein said handle having a first, second and third orifice.

4. The clamp of claim 3 wherein said handle having a leg extending therefrom, said leg contacting said base when the clamp is in an open position.

5. The clamp of claim 1 wherein said bar having a first and second orifice.

6. The clamp of claim 1 wherein said lever having a locking tab on one end.

7. The clamp of claim 1 further including a spring contacting said lever and said handle.

8. The clamp of claim 7 wherein said spring is a torque spring.

9. The clamp of claim 8 wherein said spring urges said lever away from said handle.

10. The clamp of claim 1 wherein said lever having a first and second wing member.

11. The clamp of claim 1 wherein said lever having an elongated extension member with a predetermined curve therein.

12. A hold down clamp, said clamp including:

a base having a plurality of orifices therein;

a first and second bar member, said bar members pivotally connected to said base;

a first and second link member, said link members pivotally connected to said bar members, said link members having a generally triangular shape with a wedge shape member extending from one end;

a first and second handle member pivotally connected to said base, said handle members pivotally connected to said link members; and a lever connected to said handle members.

13. The clamp of claim 12 wherein said lever locks the clamp in a fully engaged position.

14. The clamp of claim 12 wherein said link members having a stopper extending from a side thereof, said link members having a locking shoulder.

15. The clamp of claim 12 wherein said handle members having a leg extending therefrom.

16. The clamp of claim 12 further including a spring contacting said lever and said handle members.

17. The clamp of claim 16 wherein said spring is a torque spring.

18. The clamp of claim 12 wherein said lever having a tab on one end, said tab engages with a locking shoulder on said link members when the clamp is in an opened position.

19. The clamp of claim 18 wherein said lever having a first and second wing portion.

20. The clamp of claim 18 wherein said lever having a generally "shoe horn" shaped extension.

* * * * *